United States Patent [19]

Nakatani et al.

[11] Patent Number: 5,063,126

[45] Date of Patent: Nov. 5, 1991

[54] ELECTROPHOTOGRAPHIC PHOTOSENSITIVE MATERIAL

[75] Inventors: Kaname Nakatani; Yasuyuki Hanatani; Yasufumi Mizuta, all of Osaka, Japan

[73] Assignee: Mita Industrial Co., Ltd., Osaka, Japan

[21] Appl. No.: 437,277

[22] Filed: Nov. 16, 1989

Related U.S. Application Data

[63] Continuation-in-part of Ser. No. 434,406, Nov. 13, 1989, abandoned.

[30] Foreign Application Priority Data

Nov. 16, 1988 [JP] Japan ..... 63-290958
Nov. 16, 1988 [JP] Japan ..... 63-290960

[51] Int. Cl.[5] ..... G03G 5/047

[52] U.S. Cl. ..... 430/59; 430/58; 430/133

[58] Field of Search ..... 430/58, 59, 133

[56] References Cited

U.S. PATENT DOCUMENTS 3,992,205 11/1976 Wiedemann ..... 430/58
4,152,152 5/1979 Contois et al. ..... 256/501.1
4,353,971 10/1982 Chang et al. ..... 430/58
4,728,592 3/1988 Ohaku et al. ..... 430/59
4,755,443 7/1988 Suzuki et al. ..... 430/58
4,839,252 6/1989 Murata et al. ..... 430/59
4,855,202 8/1989 Yoshihara et al. ..... 430/59 X
4,882,253 11/1989 Kato et al. ..... 430/59

FOREIGN PATENT DOCUMENTS 61-292158 12/1986 Japan ..... 430/58

OTHER PUBLICATIONS

Abstract No. 63-148264, Electrophotographic Sensitive Body, vol. 12, No. 411, (p-779) [3258], Oct. 31, 1988.

Abstract No. 61-26062, Electrophotographic Sensitive Body, vol. 10, No. 177, (p-470) [2233], Jun. 23, 1986.

Abstract No. 62-30255, Electrophotographic Sensitive Body.

*Primary Examiner*—Roland Martin

*Attorney, Agent, or Firm*—Beveridge, DeGrandi & Weilacher

[57] ABSTRACT

This invention presents an electrophotographic photosensitive material wherein a charge transporting layer and a charge generating layer are laminated in this order on a conductive substrate, and the charge generating layer contains N-type dye and P-type dye at a ratio of 40/60 to 90/10 (N-type dye/P-type dye) by weight.

This electrophotographic photosensitive material is especially superior in reproductivity of red-colored originals as well as having a high sensitivity.

16 Claims, 1 Drawing Sheet

ELECTROPHOTOGRAPHIC PHOTOSENSITIVE MATERIAL

CROSS REFERENCE TO RELATED APPLICATIONS

BACKGROUND OF THE INVENTION

This invention relates to an electrophotographic photosensitive material, and more particularly to an electrophotographic photosensitive material having a high sensitivity and superior in copying red colored originals.

Recently, as an electrophotographic photosensitive material having a greater degree of freedom of function designing, a positively charged electrophotographic photosensitive material of laminated type has been suggested, in which a charge generating layer (CGL) containing a charge generating substance which generates positively and negatively charged carriers (photo-carriers) by an emission of light and a charge transporting layer (CTL) which contains a charge transporting substance transporting the generated positive charge and laminated on a conductive substrate in order of CTL and CGL.

In such a positively charged electrophotographic photosensitive material of laminated type, in order to form an electrostatic latent image, positive charges generated by light in a surface layer of CGL must be moved through the CGL to the interface between the CGL and the CTL and injected to. the CTL.

Meanwhile, as a charge generating substance, red-colored condensed polycyclic organic dyes (for example, anthanthrone series, perylene series, azo series) are widely used taking copying characteristics of color originals (especially red color) in consideration.

However, since all these dyes are N-type dyes (electron receptive dyes), they are poor in transporting performance of positive charges. Therefore, it has been a problem that a part of positive charges does not move to the interface between the CGL and the CTL upon photosensitizing and remain in the CGL, thus lowering the sensitivity of the photosensitive material.

SUMMARY OF THE INVENTION

It is hence a primary object of the invention to present a positively charged electrophotographic photosensitive material having a high sensitivity and superior in copying red-colored originals.

This invention presents an electrophotographic photosensitive material wherein a charge transporting layer and a charge generating layer are laminated in sequence on a conductive substrate, and the charge generating layer contains an N-type dye and a P-type dye at a ratio of 40/60 to 90/10 (N-type dye/P-type dye) by weight.

As the N-type dye, enthanthrone compounds, perylene compounds and azo compounds are mainly used, and as the P-type dye, phthalocyanine compounds are mainly used.

In the photosensitivc material of the invention, when the photosensitive material is positively charged by corona discharge, heat holes in the P-type dye are injected into the charge transporting layer, and a negative space-charge is generated in the charge generating layer. This negative space-charge emphasizes an electric field in the charge generating layer for generation of photo-carriers and affects to improve the generation efficiency of photo-carriers in the subsequent exposure process.

Then, by exposing the photosensitive material in such state by a color original, both positively and negatively charged photo-carriers are generated from the P-type dye having light absorption edge of 550 to 600 nm and superior in copying especially red-color, and out of them, positive charges are transported through the charge generating layer to the interface with the charge transporting layer by the P-type dye which is superior in hole transporting ability and injected into the charge transporting layer. On the other hand, the negative charges are neutralized by positive charges induced in the surface layer of the photosensitive material upon charging, and thus, an electrostatic latent image is formed on the exposed part.

DETAILED DESCRIPTION OF THE INVENTION

Figure 1:
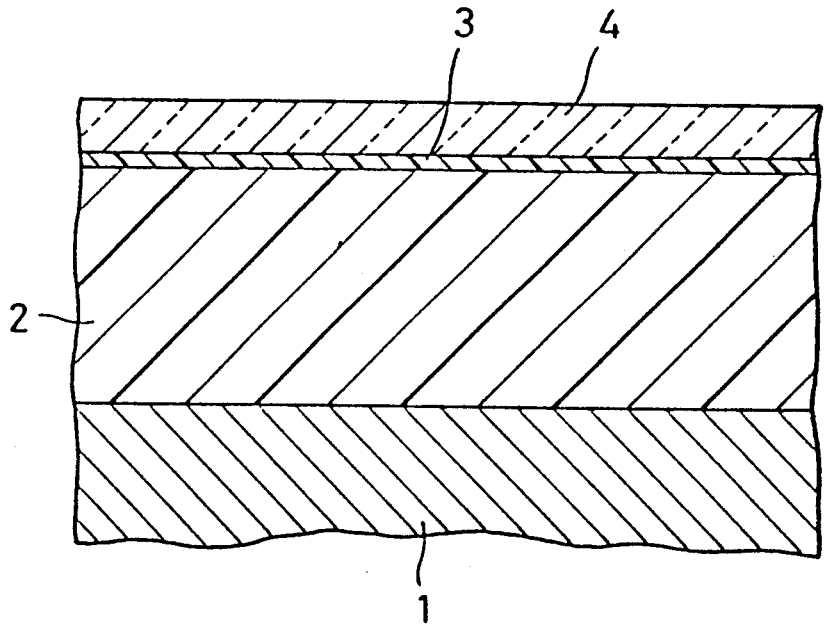
FIG. 1 is a sectional view showing an example of the layer construction of the electrophotographic photosensitive material.

As shown in FIG. 1, a photosensitive material of this invention comprises a charge transporting layer 2 containing a charge transporting material and a charge generating layer 3 containing two types of dyes, N-type and P-type, as charge generating materials, which are laminated on the surface of a conductive substrate 1 in this succession. In the photosensitive material of this invention, as shown in the figure, a surface protection layer 4 to improve the wear resistance of the photosensitive material can be laminated over the charge generating layer 3, if required.

The reason of employing P-type dye in the charge generating layer 3 is, as mentioned before, to emphasize electric fields for generating photo-carriers and to improve the sensitivity by an improved hole transporting ability through the charge generating layer.

Moreover, in a photosensitive material of this invention, the ratio by weight of the two dyes (N-type dye/P-type dye, hereinafter called "N/P ratio") is within a range of 40/60 to 90/10.

The reason of thus specifying the ratio by weight is that in the case that the N/P ratio exceeds 90/10, as the content of P-type dye in the layer relatively decreases, the emphasis of electric fields and the hole transporting ability are weakened and the sensitivity deteriorates. In the case that the N/P ratio is less than 40/60, as the content of N-type dye relatively decreases, the sensitivity and the copying performance of red-colored originals deteriorate.

As N-type dye and P-type dye used for this invention, various conventionally known dyes can be used.

In other words, as the N-type dye, perylene compounds, anthanthrone compounds, azo compounds, xanthene and acridine, which have amino group or its derivative as substitution group, are listed as examples, and out of them, anthanthrone compounds are preferably used from the point of a high generating efficiency of photo-carriers.

As the P-type dye, azo compounds having sulfone group or carboxyl group, anthraquinone compounds, triphenylmethane compounds, nitro compounds, azine compounds, quinoline compounds and other various dyes and phthalocyanine compounds are listed as examples, out of which phthalocyanine compounds which are harmless and superior in processability are preferably used. Especially, metal-free phtyalocyanine or oxotitanyl phthalocyanine in phthalocyanine compounds is most preferably used in view of increasing a sensitivity incopying.

As charge transporting substance contained in the charge transporting layer 2, fluorenone compounds such as tetracyanoethylene, 2,4,7-trinitro-9-fluorenone, nitro compounds such as 2,4,8-trinitro thioxanthone, dinitrianthracene, oxadiazole compounds such as succinic anhydride, maleic anhydride, dibromo maleic anhydride, 2,5-di(4-dimethyl aminophenyl)-1, 3,4-oxadiazole, styrile compounds such as 9-(4-diethyl amino styrile)anthracene, carbazole compounds such as polyvinyl carbazole, pyrazoline compounds such as 1-phenyl-3-(p-dimethyl aminophenyl)pyrazoline, amine derivatives such as 4,4',4''-tris(N,N-diphenyl amino)-triphenyl amine, 4,4'-bisN-phenyl-N-(3-methylphenyl-)amin] diphenyl, conjugate unsaturated compounds such as 1,1-bis(4-diethyl aminophenyl)-4,4-diphenyl-1,3-butadiene, hydrazone compounds such as 4-(N,N-diethyl amino)benzaldehyde-N,N-diphenyl hydrazone, nitric ring compounds such as indole compounds, oxazole compounds, isoxazole compounds, thiazole compounds, thiadiazole compounds, imidazole compounds, pyrazole compounds and thoriazole compounds and condensed polycyclic compounds are listed. One or plural types of these charge transporting materials are used in combination.

According to this invention, a preferable charge transporting substance is the combination of butadine derivative represented by general formula (I):

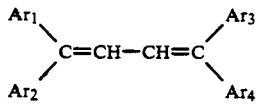

(I)

wherein $Ar_1$ to $Ar_4$ are aryl groups, each of which may have substituent, and hydrazone compounds, preferably at least one selected from 4-(N,N-diethylamino)(benzaldehyde-N,N-diphenlyhydrazone and 4-(N,N-dimethylamino)benzaldehyde-N,N-diphenylhydrazone is employed. In this case, as the combination ratio of both compounds, 10 to 300 parts by weight of hydrzone compound are preferably used to 100 parts by weight of butadiene derivative.

By using charge transporting substances in such a combination, sensitivity of the laminated photosensitive material of this invention is increased, and generation of crystallization or cracks of the charge transporting layer are prevented. That is, the above butadiene derivative has a conjugated double bond and benezene rings, and thus 90-electrons of this compound extend flatly, whereby the butadiene derivative is excellent in charge transporting capacity.

However, a butadiene derivative is inferior in compatibility to a binding resin which is contained in the charge transporting layer, and has a high cohesion. Therefore, when using a solvent having high solubility such as ester-type, ektone-type, or aromatic-type solvent in applying a coating solution for charge generating layer, crystallization or cracks occur due to so-called "solvent shock". On the other hand, a hydrzone compound, especially each of the two hydrazone compounds mentioned above, is superior to butadiene derivative in compatibility to the binding resin, and thus functions as a plasticizer, so that compatibility of butadiene derivative is stabilized to prevent crystallization or cracks.

Also, since a solutiblity of hydrazone compound to an alcohol-type solvent is about 0.1 to 2%, and hydrzone compound has charge transporting capacity in itself, when using the alcohol-type solvent in applying a coating solution for charge generating layer instead of ester-type solvent or the like mentioned above, a part of the hydrazone compound is dissolved and diffused into the charge generating layer, and therefore injection of charge from charge generating layer to charge transporting layer is smoothly carried out, so that sensitivity of the photosensitive material is increased.

Examples of butadiene derivatives are disclosed in Japanese Unexamined Patent Publication (kokai) No. 30255/1987, and especially in view of excellent charge transporting capacity, the compound of the following formula (III) is preferably used:

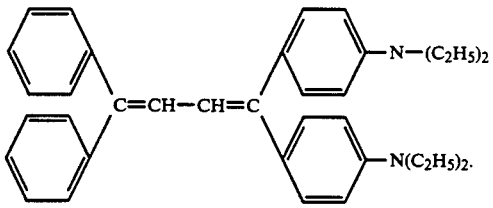

(III)

Hydrazone compounds preferably used in this invention are presented by the following formula (II):

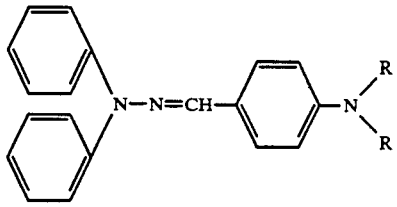

(II)

wherein R is a $C_1$-$C_4$ alkyl group, preferably a methyl group or an ehtyl group. These hydrzone compounds have oxidation potentials near that of butadiene derivatives, to present charges from being trapped, which occurs in the case of large difference of oxidation potential between two charge transporting substance.

In the charge transporting layer 2 and the charge generating layer 3, a binding resin is generally contained in addition to the charge generating substances and charge transporting substances. As usable binding resins, for example, olefine polymers such as styrene polymers, acrylic polymers, styrene-acrylic copolymers, polyethylene, ethylene-vinyl acetate copolymers, chlorinated polyethylene, polypropylene, ionomer; polyvinyl chloride vinyl chloride-vinyl acetate copolymer, polyester, alkyd resin polyamide, polyurethane, epoxy resin, polycarbonate, polyarylate, polysulfone, diallyl phthalate resin, silicone resine, ketone resin, polyvinyl butyric, polyether, phenol resin, melamine resin, benzoguanamine resin, epoxyacrylate, urethane acrylate and polyester acrylate are listed. One or plural types of these binding resins are used in combination. Out of the charge transporting substances, poly-N-vinyl carbazole which is a photoconductive polymer can be used as a binding resin as well.

Among these resins, polyarylate resin is preferably used for forming the charge transporting layer in view of compatibility to the charge transporting substance and membrane forming character.

In the charge transporting layer 2 and the charge generating layer 3, sensitizers such as terphenyl, halonaphthoquinenes and acenaphthylene, antioxidants, ultrmviolet absorbents and plasticizers may be included.

The photosensitive material is produced by firstly forming a charge transporting layer 2 by applying a coating solution for charge transporting layer containing charge transporting substance, binding resin and solvent on the surface of conductive substrate 1, then, laminating a charge generating layer 3 on the charge transporting layer 2 by applying a coating solution for charge generating layer containing P-type dyes and N-type dyes as charge generating substances, binding resin and solvent, and if required, laminating a surface protection layer 4 by applying a coating solution for surface protection layer containing binding resin and solvent.

Upon forming the charge transporting layer 2, while the ratio of charge transporting substances to binding resin can be chosen appropriately, 30 to 500 parts by weight of binding resin are generally used to 100 parts by weight of charge transporting substances. The charge transporting layer 2 can be formed in an appropriate thickness, and it is generally formed approximately in 10 to 30 μm. Examples of solvents in which the charge transporting substance is admixed with the binding resin are alcohols, Cellosoves, esters, aliphatic hydrocarbons, aromatic hydrocarbons, halogenide hydrocarbons, ethers, dimentylforamide or the like.

On the other hand, upon forming the charge generating layer 3, 1 to 300 parts by weight of binding resin are generally used to 100 parts by weight of P-type and N-type dyes as charge generating substances. The charge generating layer 3 is generally forced approximately 0.3 to 1 μm in film thickness.

A coating solution for the charge generating layer 3 is prepared busying the alcohol-type solvent. Examples of the alcohol-type solvent are methyl alcohol, ehtyl alcohol, ispropyl alcohol, n-butyl alcohol or the like. Among these solvents, isopropyl alcohol or butyl alcohol are most preferably used. While solubility of the butadine derivative to these alcohol-type solvents is poor, the hydrazone compound has a solubility of about 0.1 to 2% to these alcohol-type solvents. therefore, when coating, since a part of hydrzone compound is dissolved and diffused into charge generating layer, it prevents the generation of an electric barrier in the interface between charge generating layer and charge transporting layer.

Upon forming the charge generating layer 3, P-type and N-type dyes as charge generating substances can be directly formed on the charge transporting layer 2 by utilizing film forming methods such as vacuum evaporation and sputtering without using binding resin.

The surface protection layer 4 laminated on the charge generating layer 3 as required is formed with binding resin, especially silicone resin. If required, ultraviolet absorbents, entioxidants, conductivity additives can be included in this surface protection layer 4. The surface protection layer 4 is generally formed approximately 0.1 to 10 μm in film thickness.

Upon preparation of coating solutions to form the charge generating layer 3, charge transporting layer 2 and surface protection layer 4, conventional methods such as a mixer, a ball mill, a paint shaker, a sand mill, an attriter and a supersonic dispenser can be used in combination. Upon applying the coating solutions, various conventional coating methods such as dip-coating, spray-coating, spin-coating, roller-coating, blade-coating, curtain-coating and bar-coating can be employed.

As the conductive substrate 1 on which the layers are laminated, various conductive materials such as aluminum, aluminum alloys, copper, tin, platinum, gold, silver, vanadium, molybdenum, chromium, cadmium, titanium, nickel, palladium, indium, stainless steel, brass and other metallic single elements, plastic materials or glass on which a conductive layer of a metal, indium oxide, tin oxide is formed by a method such as evaporation are listed. The conductive substrate 1 can be formed in various shapes such as sheet or drum. In order to improve the adhesiveness with the layers formed of the above surfaces, out of conductive materials, those having oxide surfaces, especially alumite treated aluminum, and more specifically alumite treated aluminum of which alumite treated layer has 5 to 12 μm thickness and surface roughness is 1.5 S or less, is preferably used as conductive substrate 1. In order to further improve the adhesiveness between the conductive substrate 1 and the charge transporting layer 2, the surface of the conductive substrate 1 can be treated by surface treatment agents such as silane coupling agent and titanium coupling agent.

EXAMPLES

Referring now to the examples, the invention is described in detail below.

EXAMPLE 1 to 5

Formulation of coating solution for charge generating layer

Coating solutions for charge generating layer were formulated by the following components by changing the N/P ratio of content N of N-type dye to content P of P-type dye in the examples within 40/60 to 90/10 (N/P ratio as shown in Table 1.

| (Component) | (Parts by weight) |
|---|---|
| P-type dye (metal-free phthalocyanine) | P |
| N-type dye (dibromo anthanthrone) | N |
| Polyvinyl butyral (prepared by Sekisui Chemical Co., Ltd. trade name "S-lec BM-2") | 100 |
| Isopropyl alcohol | 2,000 |

Formulation of coating solution for charge transporting layer

A coating solution for charge transporting layer was formulated in the following composition.

| (Component) | (Parts by weight) |
|---|---|
| p-Diethylamino benzalodehyde diphenyl hydrazone | 100 |
| Polyarylate (prepared by Unitika Ltd., trade name "U-100") | 100 |
| Dichloromethane | 900 |

Production of photosensitive material

The coating solution for charge transporting layer was applied on an aluminum conductive substrate by dipping, then by drying it for 30 min at a temperature of 90° C., a charge transporting layer was produced. Successively, the coating solution for charge generating layer was applied on the charge transporting layer by dipping, dried for 30 min at a temperature of 110° C. to form a charge generating layer, and a positively charged electrophotographic photosensitive material of laminated type was produced.

Comparison examples 1 to 5

As shown in Table 1, electrophotographic photosensitive materials were produced in the same methods in examples 1 to 5 except that the N/P ratios less than 40/60 or more than EXAMPLES 6 to 10

Electrophotographic photosensitive materials were produced in the same method as in examples 1 to 5, except that a perylene compound shown by the following formula was used as N-type dye in the place of dibromo anthanthrone.

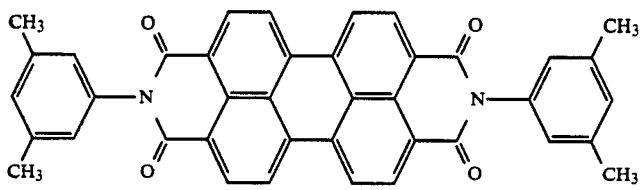

Comparison examples 6 to 10

As shown in Table 2, electrophotographic photosensitive materials were produced in the same methods in examples 6 to 10 except that the N/P ratios less than 40/60 or more than 90/10 were used.

EXAMPLES 11 to 15

Electrophotographic photosensitive materials were produced in the same method ms in examples 1 to 5 except that en azo compound shown by the following formula was used as N-type dye in the place of dibromo enthanthrone.

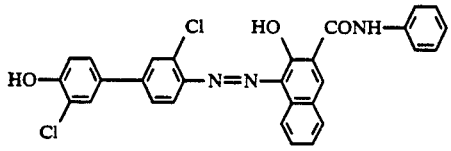

Comparison examples 11 to 15

As shown in Table 3, electrophotographic photosensitive materials were produced in the same method as in examples 11 to 15 except that the N/P ratios less than 40/60 or more than 90/10 were used Examples 16 to 20

Electrophotographic photosensitive materials were produced in the same method as in examples 1 to 5 except that a copper phthalocyanine was used as P-type dye in the place of metal-free phthalocyanine.

Comparison examples 16 to 20

As shown in Table 4, electrophotographic photosensitive materials were produced in the same method as in examples 16 to 20 except that the N/P ratios less than 40/60 or more than 90/10 were used.

Evaluation test

In order to examine charging characteristic of each photosensitive material for electrophotography obtained in the examples and comparison examples, each electrophotographic photosensitive material was positively charged and the surface potentials (V) were measured.

In addition, by charging the electrophotographic photosensitive materials at 700V, exposing the photosensitive materials at an intensity of lumination of 771 lux through a 465 to 600 nm pass filter by using a halogen lamp, measuring the time till the surface potentials become half, the half-value exposures were calculated.

Furthermore, the reflection density of a copy was measured when copying a red-colored original having a reflection density of 0.7, and the value was taken as evaluation value showing superiority or inferiority in copying red-colored originals.

The surface potentials, half-value exposures and evaluation values of copying performance of red-colored originals are shown in Tables 1 to 4.

TABLE 1

| | P-type dye (parts by weight) | N-type dye (parts by weight) | Surface potential (V) | Half-value exposure (lux · sec) | Copying performance of red-colored originals |
|---|---|---|---|---|---|
| Example 1 | 10 | 90 | 744 | 4.1 | 0.91 |
| Example 2 | 20 | 80 | 745 | 3.7 | 0.90 |
| Example 3 | 30 | 70 | 727 | 3.2 | 0.85 |
| Example 4 | 50 | 50 | 668 | 3.4 | 0.60 |
| Example 5 | 60 | 40 | 623 | 4.0 | 0.30 |
| Comparison example 1 | 70 | 30 | 610 | 5.3 | 0.21 |
| Comparison | 80 | 20 | 550 | 6.0 | 0.03 |

TABLE 1-continued

| | P-type dye (parts by weight) | N-type dye (parts by weight) | Surface potential (V) | Half-value exposure (lux · sec) | Copying performance of red-colored originals |
|---|---|---|---|---|---|
| example 2 | | | | | |
| Comparison example 3 | 100 | 0 | 563 | 7.0 | 0.03 |
| Comparison example 4 | 5 | 95 | 750 | 5.0 | 0.92 |
| Comparison example 5 | 0 | 100 | 752 | 5.2 | 0.95 |

TABLE 2

| | P-type dye (parts by weight) | N-type dye (parts by weight) | Surface potential (V) | Half-value exposure (lux · sec) | Copying performance of red-colored originals |
|---|---|---|---|---|---|
| Example 6 | 10 | 90 | 707 | 5.7 | 0.91 |
| Example 7 | 20 | 80 | 700 | 5.2 | 0.91 |
| Example 8 | 30 | 70 | 705 | 4.5 | 0.86 |
| Example 9 | 50 | 50 | 650 | 4.4 | 0.58 |
| Example 10 | 60 | 40 | 632 | 4.9 | 0.31 |
| Comparison example 6 | 70 | 30 | 590 | 6.0 | 0.22 |
| Comparison example 7 | 80 | 20 | 523 | 6.8 | 0.04 |
| Comparison example 8 | 100 | 0 | 563 | 7.0 | 0.03 |
| Comparison example 9 | 5 | 95 | 720 | 6.3 | 0.91 |
| Comparison example 10 | 0 | 100 | 722 | 6.5 | 0.94 |

TABLE 3

| | P-type dye (parts by weight) | N-type dye (parts by weight) | Surface potential (V) | Half-value exposure (lux · sec) | Copying performance of red-colored originals |
|---|---|---|---|---|---|
| Example 11 | 10 | 90 | 796 | 3.8 | 0.92 |
| Example 12 | 20 | 80 | 783 | 3.4 | 0.90 |
| Example 13 | 30 | 70 | 758 | 3.0 | 0.86 |
| Example 14 | 50 | 50 | 721 | 3.0 | 0.61 |
| Example 15 | 60 | 40 | 680 | 4.0 | 0.33 |
| Comparison example 11 | 70 | 30 | 633 | 4.9 | 0.22 |
| Comparison example 12 | 80 | 20 | 562 | 7.0 | 0.04 |
| Comparison example 13 | 100 | 0 | 563 | 7.0 | 0.03 |
| Comparison example 14 | 5 | 95 | 830 | 4.3 | 0.94 |
| Comparison example 15 | 0 | 100 | 827 | 4.3 | 0.94 |

TABLE 4

| | P-type dye (parts by weight) | N-type dye (parts by weight) | Surface potential (V) | Half-value exposure (lux · sec) | Copying performance of red-colored originals |
|---|---|---|---|---|---|
| Example 16 | 10 | 90 | 698 | 3.9 | 0.91 |
| Example 17 | 20 | 80 | 683 | 2.9 | 0.91 |
| Example 18 | 30 | 70 | 623 | 2.8 | 0.83 |
| Example 19 | 50 | 50 | 601 | 3.4 | 0.62 |
| Example 20 | 60 | 40 | 555 | 3.6 | 0.32 |
| Comparison example 16 | 70 | 30 | 531 | 5.1 | 0.19 |
| Comparison example 17 | 80 | 20 | 522 | 5.2 | 0.03 |
| Comparison example 18 | 100 | 0 | 490 | 5.9 | 0.02 |
| Comparison example 19 | 5 | 95 | 743 | 5.1 | 0.91 |
| Comparison example 20 | 0 | 100 | 752 | 5.2 | 0.95 |

As known from Table 1, in the electrophotographic photosensitive materials of the examples 1 to 5 in which the N/P ratios are between 40/60 and 90/10, both the half-value exposures and copying performances of red-colored originals show values that can be practically used, while in the electrophotographic photosensitive materials of the comparison examples 1 to 5 in which the N/P ratios are out of the above range, at least one of the half-value exposure and copying performance of red-colored originals is inferior. In other words, in the comparison examples 1 to 3, both the half-value exposure and copying performance of red-colored originals are inferior, and the comparison examples 4 and 5 are superior in reproductivity of red-colored originals but have a large half-value exposure.

From Tables 2 to 4 which show the results of examinations by using different P-type dye or N-type dye from the examples 1 to 5, it is found that the same results were obtained even by changing P-type or N-type dyes.

EXAMPLES 21 to 25

Formulation of coating solution for charge transporting layer

As charge transporting substance, 1,1-diphenyl-4,4-(4-N,N-diethylamino)diphenyl-butadiene represented by formula (III) (hereinafter referred to as A compound) and 4-(N,N-diethylamino)benzaldehyde-N,N-diphenylhydrazone (hereinafter referred to as B compound) were used, and as a binding resin, polyarylate (prepared by Unitika Ltd., tracxe name "U-100") was used. Contents of the charge transporting substances against 100 parts by weight of the binding resin are shown in Table 5. Furthermore, 900 parts by weight of methylene chloride were admised as solvent to form a coating solution.

Formulation of coating solution for charge generating layer

A coating solution for the charge generating layer was formulated in the following composition busying alcohol-type soolvent shown in Table 5.

| (Component) | (Parts by Weight) |
|---|---|
| Dibromo anthanthrone | 100 |
| Polyvinyl butyral | 100 |
| solvent | 2000 |

Production of photosensitive material

The coating solution of the charge transporting layer was applied on an aluminum conductive substrate by dipping, then by drying it for 30 minutes at 90° C. A charge transporting layer was produced. Successively, the coating solution for the charge generating layer was applied on the charge transporting layer by dipping, dried for 30 minutes at 110° C. to form a charge generating layer having a thickness of 0.5 μm. Thus, a photosensitive material was produced.

COMPARISON EXAMPLES 21 TO 25

Electrophotographic photosensitive materials were produced in the same method as in Examples 21 to 25 except that "A compound" and "B compound" which are charge transporting substances were used in the ratios shown in Table 5, and solvents for the charge generating layer shown in Table 5 were used.

EXAMPLES 26 TO 30

Electrophotographic photosensitive materials were produced in the same method as in Examples 21 to 25 except that 4-(N,N-dimethylamino)benzaldehyde-N,N-diphenylhydrazone was used as "B compound" was used in the place of 4-(N,N-diethylamino)benzaldehyde-N,N-diphenylhydrazone.

COMPARISON EXAMPLES 26 TO 30

Electrophotographic photosensitive materials were producing the same method as in Examples 26 to 30 except that "A compound" and "B compound" which are charge transporting substances were used in the ratio shown in Table 6, and the solvents for charge generating layer shown in Table 6 were used.

Evaluation Test

Surface poetical (V) and half-value exposure (lux sec) were determined in the same method as in Examples 1 to 20. Results are shown in Tables 5 and 6. In the Tables, MIBK means methyl isobutyl ketone.

TABLE 5

| | Content of A compound (parts by weight) | Content of B compound (parts by weight) | Solvent | Surface potential (V) | Half-value exposure (lux · sec) | Copying performance of red-colored originals |
|---|---|---|---|---|---|---|
| Example 21 | 90 | 10 | isopropyl alcohol | 752 | 3.7 | 0.94 |
| Example 22 | 70 | 30 | isopropyl alcohol | 748 | 2.4 | 0.94 |
| Example 23 | 50 | 50 | isopropyl alcohol | 721 | 2.5 | 0.95 |
| Example 24 | 40 | 60 | isopropyl alcohol | 731 | 2.7 | 0.94 |
| Example 25 | 25 | 75 | isopropyl alcohol | 728 | 3.8 | 0.95 |
| Comparison Example 21 | 100 | 0 | isopropyl alcohol | 894 | 67.0 | 0.96 |
| Comparison Example 22 | 100 | 0 | MIBK | — | — | — |
| Comparison Example 23 | 100 | 0 | ethyl acetate | — | — | — |
| Comparison Example 24 | 95 | 5 | ethyl acetate | — | — | — |
| Comparison Example 25 | 0 | 100 | isopropyl alcohol | 769 | 6.0 | 0.95 |

TABLE 6

| | Content of A compound (parts by weight) | Content of B compound (parts by weight) | Solvent | Surface potential (V) | Half-value exposure (lux · sec) | Copying performance of red-colored originals |
|---|---|---|---|---|---|---|
| Example 26 | 90 | 10 | isopropyl alcohol | 771 | 4.4 | 0.95 |
| Example 27 | 70 | 30 | isopropyl alcohol | 762 | 2.7 | 0.94 |
| Example 28 | 50 | 50 | isopropyl alcohol | 763 | 2.9 | 0.94 |
| Example 29 | 40 | 60 | isopropyl alcohol | 749 | 3.1 | 0.95 |
| Example 30 | 25 | 75 | isopropyl alcohol | 744 | 4.4 | 0.94 |
| Comparison Example 26 | 100 | 0 | isopropyl alcohol | 894 | 67.0 | 0.96 |
| Comparison Example 27 | 100 | 0 | MIBK | — | — | — |
| Comparison Example 28 | 100 | 0 | ethyl acetate | — | — | — |
| Comparison Example 29 | 95 | 5 | ethyl acetate | — | — | — |
| Comparison Example 30 | 0 | 100 | isopropyl alcohol | 907 | 6.8 | 0.95 |

As known from Tables 5 and 6, Comparison Examples 21 and 26 are inferior in sensitivity, since these comparison examples do not contain B compound, and they use alcohol solvent which does not almost dissolve A compound (butadine compound). Also, in Comparison Examples 22 and 27, cracks and crystallizations occur, and thus surface potentials and half-value exposures cannot be determined, since other solvents except for alcohol solvent were used. From the same reason, in Comparison Examples 23, 24, 28 and 29, cracks and crystallizations occurred. Furthermore, Comparison Examples 25 and 30 do not have sufficient sensitivity, since the charge transporting substance is B compound only.

On the other hand, photosensitive materials obtained in Examples 21 to 25 and 26 to 30 were superior to comparison examples in sensitivity without generating cracks and crystallizations, since A and B compounds are contained in the charge transporting layer, and alcohol solvent is used as the solvent of the charge generating layer.

EXAMPLE 31

As a coating solution for the charge generating layer, the same solution as in Example 3 (P-type dye : N-type dye =30:70, solvent is 2000 parts by weight of isopropyl alcohol) was used, as a coating solution for charge transporting layer, the same solution as in Example 27 (A compound : B compound =70:30, B compound is 4-(N,N-dimethylamino)benzaldehyde-N,N-diphenylhydrazone) was used, and then photosensitive material was produced in the same method as "Production of photosensitive material" in Example 3.

EXAMPLE 32

Photosensitive material was produced in the same method as in Example 31 except that n-butyl alcohol was used in the place of isopropyl alcohol as a solvent for charge generating layer, and that 4-(N,N-diethylamino)benzaldehyde-N,N-diphenylhydrazone was used in the place of 4-(N,N-diemthylamino)benzaldehyde-N,N-diphenylhydrazone.

EXAMPLE 33

Photosensitive material was produced in the same method as in Example 31 except that oxo-titanyl phthalocyanine was used as P-type dye in the place of metal-free phtyalocyanine, and that 4-(N,N-diethylamino)-benxaldehyde-N,N-diphenylhydrazone was used in the place of 4-(N,N-dimethylamino)benzaldehyde-N,N-diphenylhydrazone.

EXAMPLE 34

Photosensitive material was produced in the same method as in Example 33 except that n-butyl alcohol was used in the place of isopropyl alcohol as the solvent for the charge generating layer.

EXAMPLES 35 TO 39

Electrophotographic photosensitive materials were produced in the same method as in Example 34 except that, as shown in Table 7, a ratio of P-type dye (oxo-titanyl phthalocyanine) : N-type dye (dibromo anthanthrone), alcohol solvents for producing a charge generating layer, a ratio of A compound : B compound are changed.

Values in ratios of P : N and A : B shown in Table 7 mean "parts by weight" against 100 parts by weight of the binding resin.

Evaluation test

Surface potentials (V), half-value exposure (lux sec) and copying performance of red-colored originals were determined in the same methods as in Examples 1 to 20. Results are shown in Table 7. In Table 7, "P : N" means a ratio of P-type dye and N-type dye. Also, "A : B" means a ratio of A compound and B compound.

TABLE 7

| | Charge generating layer | | | Charge transporting layer | | Surface potential | Half-Value exposure | Copying performance of red-colored |
|---|---|---|---|---|---|---|---|---|
| | P | N | Solvent | A | B | (V) | (lux · sec) | originals |
| Example 31 | 30 | 70 | IPA* | 70 | 30 | 764 | 2.3 | 0.85 |
| Example 32 | 30 | 70 | n-BuOH** | 70 | 30 | 752 | 2.2 | 0.86 |
| Example 33 | 30 | 70 | IPA* | 70 | 30 | 758 | 2.1 | 0.84 |
| Example 34 | 30 | 70 | n-BuOH** | 70 | 30 | 761 | 2.0 | 0.85 |
| Example 35 | 45 | 105 | IPA* | 70 | 30 | 758 | 1.9 | 0.85 |
| Example 36 | 45 | 105 | n-BuOH** | 70 | 30 | 751 | 1.8 | 0.85 |

TABLE 7-continued

| | Charge generating layer | | | Charge transporting layer | | Surface potential | Half-Value exposure | Copying performance of red-colored |
|---|---|---|---|---|---|---|---|---|
| | P | N | Solvent | A | B | (V) | (lux · sec) | originals |
| Example 37 | 60 | 140 | IPA* | 70 | 30 | 763 | 1.7 | 0.84 |
| Example 38 | 60 | 140 | n-BuOH** | 70 | 30 | 761 | 1.6 | 0.85 |
| Example 39 | 60 | 140 | n-BuOH** | 100 | 50 | 755 | 1.5 | 0.85 |

*IPA: Isopropyl alcohol
*n-BuOH: N-Butyl alcohol

As known from Table 7, the electrophotographic photosensitive materials of Examples 31 to 34 are remarkably superior in sensitivity (please see half-value exposure).

What is claimed is:

1. An positively charged electrophotographic photosensitive material comprising a charge transporting layer and a charge generating layer which are laminated in this order on a conductive substrate, wherein the charge generating layer contains a N-type dye and a P-type as charge generating substances dye at a ratio of 40/60 top 90/10 (N-type dye/P-type dye) by weight.

2. An electrophotographic photosensitive material according to claim 1, wherein the N-type dye is an anthanthrone compound.

3. An electrophotographic photosensitive material according to claim 1, wherein the N-type dye is a perylene compound.

4. An electrophotographic photosensitive material according to claim 1, wherein the N-type dye is an azo compound.

5. An electrophotographic photosensitive material according to claim 1, wherein the P-type dye is a phthalocyanine compound.

6. An electrophotographic photosensitive material according to claim 1, wherein the charge generating layer contains 1 to 300 parts by weight of a binding resin to 100 parts by weight of a sum of N-type dye and P-type dye.

7. An electrophotographic photosensitive material according to claim 1, wherein the film thickness of the charge generating layer is 0.3 to 1 μm.

8. An electrophotographic photosensitive material. according to claim 5, wherein the phthalocyanine compound is oxo-titanyl phthalocyanine.

9. A positively charged electrophotographic photosensitive material comprising a charge transporting layer and a charge generating layer which are laminated in this order on a conductive substrate, the charge transporting layer containing, as charge transporting substances, a butadiene derivative represented by the general formula (I):

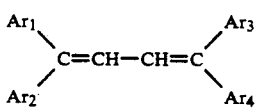

wherein $Ar_1$ to $Ar_4$ are aryl groups, each of which may have substituent, and a hydrazone compound represented by the general formula (II):

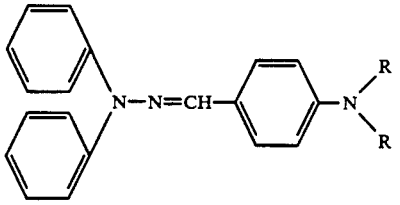

wherein R is a $C_1$–$C_4$ alkyl group.

10. An electrophotographic photosensitive material according to claim 9, wherein the hydrazone compound is at least one selected from the group consisting of 4-(N,N-diethylamino)benxzaldehyde-N,N-diphenylhydrazone and 4-(N,N-dimethylamino)benzaldehyde-N,N-diphenylhydrazone.

11. An electrophotographic photosensitive material according to claim 9, wherein the butadiene derivative is represented by the following formula (III):

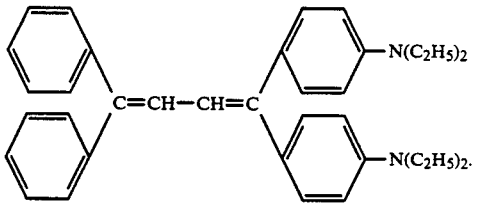

(III)

12. An electrophotographic photosensitive material according to claim 9, wherein the charge generating layer is formed by applying a coating solution, which is prepared by using an alcohol solvent, on the charge transporting layer.

13. An electrophotographic photosensitive material according to claim 9, wherein the alcohol solvent is an isopropyl alcohol or a n-butyl alcohol.

14. An electrophotographic photosensitive marital according to claim 13, wherein the alcohol solvent is a n-butyl alcohol.

15. A positively charged electrophotographic photosensitive material comprising a charge transporting layer and a charge generating layer which are laminated in this order on a conductive substrate, the charge transporting layer containing the butadiene derivative and hydrzone compound defined in claim 9 as charge transporting substances, and the charge generating layer containing the N-type dye and the P-type as charge generating dye defined in claim 1.

16. A process a positively charged electrophotographic photosensitive material comprising a step for applying a coating solution for a charge transporting layer which contains the charge transporting substances defined in claim 90 to form the charge transporting layer; and a step for applying a coating solution for a charge generating layer, which is prepared by using an alcohol solvent, on the charge transporting layer to form the charge generating layer.

* * * * *